US005215604A

United States Patent [19]

Crawford

[11] Patent Number: 5,215,604

[45] Date of Patent: Jun. 1, 1993

[54] LONG-WEAR PACKERHEAD SEGMENT

[75] Inventor: Gerald R. Crawford, Ponca, Nebr.

[73] Assignee: International Pipe Machinery Corporation, Sioux City, Iowa

[21] Appl. No.: 561,047

[22] Filed: Aug. 1, 1990

[51] Int. Cl.[5] ..... C22C 37/08

[52] U.S. Cl. ..... 148/324; 420/15; 420/16; 420/17

[58] Field of Search ..... 420/15, 16, 17; 148/324

[56] References Cited

FOREIGN PATENT DOCUMENTS 763482 9/1980 U.S.S.R. ..... 148/324

1125278 11/1984 U.S.S.R. ..... 148/324

*Primary Examiner*—Deborah Yee

*Attorney, Agent, or Firm*—Baker & McKenzie

[57] ABSTRACT

A wear segment for use in a concrete pipe making machine is provided which has increased wear resistance as contrasted to wear segments currently in use. The segment has a Rockwell C hardness of about 68 in the heat treated condition and has very improved wear to a considerable degree over prior art segments which have had a typical Rc hardness of about 58.

2 Claims, 1 Drawing Sheet

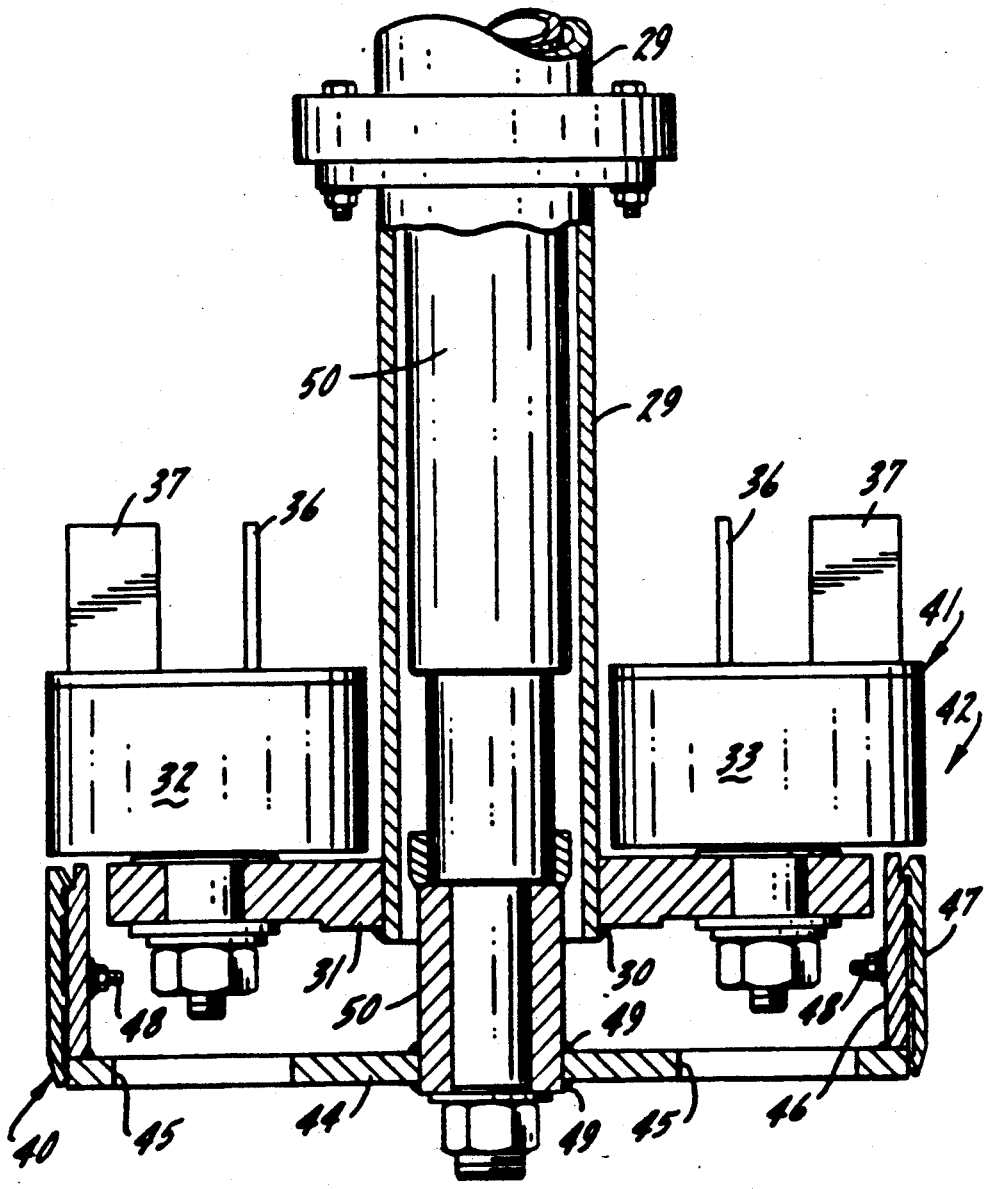
29
50
29
37
36
36
37
41
42
32
33
47
31
30
48
50
49
48
40
45
44
49
45
46

LONG-WEAR PACKERHEAD SEGMENT

This invention relates generally to concrete pipe making machinery and, more specifically, to a wear-segment for the longbottom of a packerhead in a concrete pipe making machine.

SUMMARY OF THE INVENTION

A wear segment for use in a concrete pipe making machine is provided which has increased wear resistance as contrasted to wear segments currently in use. The segment has a Rockwell C hardness of about 68 in the heat treated condition and has very improved wear to a considerable degree over prior art segments which have had a typical Rc hardness of about 58.

DESCRIPTION OF THE DRAWING

The invention is illustrated more or less diagrammatically in the accompanying drawing in which the sole FIGURE is a section, with parts broken away for clarity, of a packerhead in a concrete pipe making machine which illustrates the wear segment of this invention, and a typical environment in which it is used.

DESCRIPTION OF SPECIFIC EMBODIMENT

Referring to the drawing, it will be seen that a rollerhead drive shaft 29 is secured, as by welds 30, to a circular roller mounting plate 31 on which a plurality of rollers 32, 33, 34, and 35 may be mounted. It will be understood that any desirable number of rollers may be employed. The rollers may include any type and number of distributing blades 36, 37.

A longbottom assembly is indicated generally at 40, the longbottom assembly and the rollerhead, indicated generally at 41, together with their respective drive means, comprising collectively, in this instance a bidirectional packerhead 42.

The longbottom assembly includes a circular bottom plate 44 having apertures 45 therein for ready access to the rollers 32–35. A mounting flange is indicated at 46, the mounting flange carrying a smooth, circular roller distributor blade or troweling member 47 which is secured entirely around the periphery of the mounting flange 46 by any suitable fastening means 48.

Circular bottom plate 44 is welded, as at 49, to a longbottom drive shaft indicated at 50.

The troweling member 47 is conventionally referred to in the trade as a wear segment, and it is to this element that this invention is particularly directed. Generally, in one standard type of machine, such wear segments are about 6" high, about 3"–4" wide, have a slight curvature which, on its inside diameter, mates with the outside diameter of the mounting flange 46, and has a counter sunk hole to receive a flat headed, unslotted bolt so that a smooth troweling surface is provided.

It has been discovered that a surprisingly long life is obtained if the wear segments are heat treated to a Rockwell C hardness of about 68, which should be contrasted to the substantially lower hardness which has heretofore been thought to be optimal. In this connection it should be noted that hardness is not necessarily a good indicator of wearability. However, it has been found that compositions having the approximate following analysis, when heat treated to about 68 Rc, yield superior wear resistance as wear segments in concrete pipe machines.

Weight %

C - from about 2.3 to about 3.0
Mn - from about 0.5 to about 1.5
Si - 1.0 max
Ni - 1.5 max
Cr - from about 23.0 to about 28.0
Mo - 1.5 max
Cu - 1.2 max
P - 0.10 max
S - 0.06 max As those skilled in the art will appreciate, the foregoing composition and supplemental information is generally described in ASTM Specification 532-82. Following casting, machining as needed, and heat treatment, the wear segments of this invention, when put into use as a component of a longbottom in a concrete pipe making machine, will give markedly superior service over wear segments currently in use in the industry.

Although a preferred embodiment of the invention has been illustrated and described, it will at once be apparent to those skilled in the art that modifications may be made without departing from the spirit and scope of the invention. Accordingly, the scope of the invention should not be confined to the foregoing claims, but solely to the following description, when interpreted in light of the relevant prior art.

I claim:

1. A concrete pipe making machine wear segment, said wear segment comprising:

a curved working face adapted to make a sliding contact with raw concrete, means for releasably securing the wear segment to a longbottom, said wear segment being fabricated from an alloy including carbon, chromium, and nickel, said alloy having a Rc hardness of about 68.

2. A carbon-chromium-nickel type concrete pipe making machine wear segment, said wear segment comprising:

a curved working face adapted to make sliding contact with raw concrete, means for releasably securing the wear segment to a longbottom, said wear segment having a Rc hardness of about 68, the approximate composition of the wear segment in weight percent being:

C - from about 2.3 to about 3.0
Mn - from about 0.5 to about 1.5
Si - 1.0 max
Ni - 1.5 max
Cr - from about 23.0 to about 28.0
Mo - 1.5 max
Cu - 1.2 max
Fe - balance with usual residuals including P and S.

* * * * *